United States Patent [19]

Coulter, Jr.

[11] Patent Number: 4,918,487

[45] Date of Patent: Apr. 17, 1990

[54] TONER APPLICATOR FOR ELECTROPHOTOGRAPHIC MICROIMAGERY

[75] Inventor: Joseph R. Coulter, Jr., Miami Springs, Fla.

[73] Assignee: Coulter Systems Corporation, Bedford, Mass.

[21] Appl. No.: 300,779

[22] Filed: Jan. 23, 1989

[51] Int. Cl.[4] ..... G03G 15/10

[52] U.S. Cl. ..... 355/256; 355/77; 355/122; 355/261

[58] Field of Search ..... 355/256, 257, 258, 261, 355/262, 77, 122

[56] References Cited

U.S. PATENT DOCUMENTS

| | | | |
|---|---|---|---|
| 4,271,785 | 6/1981 | DiNallo, Sr. et al. | 355/256 X |
| 4,400,079 | 8/1983 | Landa | 355/256 |
| 4,410,260 | 10/1983 | Kuehnle | 355/256 |
| 4,504,138 | 3/1985 | Kuehnle et al. | 355/256 |
| 4,566,781 | 1/1986 | Kuehnle | 355/256 |
| 4,690,539 | 9/1987 | Radulski et al. | 355/256 X |

*Primary Examiner*—A. C. Prescott

*Attorney, Agent, or Firm*—Silverman, Cass & Singer, Ltd.

[57] ABSTRACT

A method and apparatus for applying liquid toner to fractional areas of a photoconductive recording member in processes involving microimagery. The method includes the steps of providing a photoconductor disposed over a conductive substrate having at least one fractional area thereon that is to be toned, providing a carrier member having a conductive layer, electrostatically depositing liquid toner on the carrier member to form thereon a toner pre-deposit of desired density in an area corresponding to the fractional area to be toned on the photoconductor, contacting the toner pre-deposit on the carrier member with the fractional area on the photoconductor, and toning the fractional area on the photoconductor by transferring toner thereto from the toner pre-deposit so that the quantity of liquid transferred to the photoconductor is minimal and can be rapidly removed therefrom without affecting the toner pre-deposit on the photoconductor. The apparatus includes backing members for supporting the photoconductor and contacting the fractional areas on the photoconductor with the fractional toner predeposits on the carrier member.

43 Claims, 5 Drawing Sheets

TONER APPLICATOR FOR ELECTROPHOTOGRAPHIC MICROIMAGERY

FIELD OF THE INVENTION

This invention relates generally to electrophotography, and more particularly, to a method of and means for applying liquid toner to fractional areas of a photoconductive recording member in processes involving, but not limited to, microimagery.

BACKGROUND OF THE INVENTION

The term microimagery in the context of the present application means information produced on photoconductive microfilm, aperture cards, microfiche and the like, as is well known in the art. Such information is typically reproduced on such photoconductive recording members or film by the steps of electrostatically charging the photoconductive film, exposing it to a light pattern corresponding to the information to be reproduced, toning with a liquid toner, drying, and fusing the image deposits directly onto the photoconductive film or transferring such deposits electrostatically or by other means such as heat and/or pressure. Such processes and apparatus to carry out the processes and related liquid toner applicators are described, for example, in U.S. Pat. Nos. 3,697,176, 2,820,890, 3,972,610, 4,176,940, 4,563,080 and 4,591,543.

Photoconductor films which are particularly suitable for use in microimagery processes for the reproduction or acquisition as well as retrieval of information are, for example, crystalline cadmium sulfide sputtered on a conductive layer contained on a transparent polyester substrate as disclosed in U.S. Pat. Nos. 4,025,339 and 4,269,919, and organic photoconductors coated over a conductive layer contained on a polyester or other transparent substrate.

In a typical microfiche acquisition system, the photoconductive fiche or card contains fractional image areas or so-called "frames", which are arranged in rows. The cards may be stored in a magazine. By automatic programming and indexing of all process steps, the required fiche may be called up to exit from the magazine and the selected frame thereon to be then processed for image acquisition or annotation. In certain types of apparatus the selected frame is stationary in the processing position, in which case the devices for all functions such as charging, exposure, toning, drying and fusing or transfer are caused to sequentially operate in such a processing position. In other instances, only some of such functions are performed in the processing positions, while for certain other functions, the selected frame is caused to move or pass by other functional devices which are stationary.

In all instances, however, only one frame is processed at one time and the image produced thereon must be fully dried and fused before the next frame can be processed. Thus, it is essential that the toner applicator applies liquid toner with a minimal quantity of carrier liquid and only to a fractional area of the fiche corresponding exactly to the area of a frame, and that after completion of toning, there are means provided to remove as much as possible excess toner or carrier liquid from the frame to allow rapid drying preparatory to fusing. It also is essential that such liquid toner or carrier liquid does not spread beyond the frame area and does not soil adjacent areas on the fiche.

Various methods have been proposed to limit the quantity of liquid toner applied to a frame and to purge excess liquid for rapid drying. Examples of such methods are disclosed, for instance, in U.S. Pat. Nos. 4,563,080 and 4,591,543. The methods disclosed in these patents, however, are inadequate to remove excess liquid toner or carrier liquid fast enough in very high speed systems where the total time available to perform all process functions per frame is one second or less.

It would therefore be advantageous to provide a method and means for applying liquid toner to fractional areas of a photoconductive recording member in processes involving microimagery where the liquid is applied only to the fractional areas without spreading to adjacent areas and excess liquid is removed from the fractional areas to enable rapid drying in a very high speed system. Another desirable advantage would be to tone a fractional area on a photoconductor to a predetermined image density.

SUMMARY OF THE INVENTION

The advantages of the invention are achieved by electrostatically depositing liquid toner onto a carrier member to form thereon a toner pre-deposit of desired density in an area corresponding to the fractional area to be toned on the photoconductor, contacting said toner pre-deposit with the selected fractional area on the photoconductor, and toning such fractional area on the photoconductor by transferring said toner pre-deposit thereto from said carrier, wherein the quantity of liquid transferred to the photoconductor is minimal and can be rapidly removed therefrom. Also, apparatus is provided for practicing the method of the invention.

DESCRIPTION OF THE PREFERRED EMBODIMENTS

In the prior art liquid toning processes, the liquid toner that is applied to the photoconductor consists generally of a carrier liquid which may contain some dissolved matter and of toner particles dispersed therein which form the image deposits. The proportion of toner particles to the carrier liquid ranges normally between 1-10 percent of toner particles to 99-90 percent of carrier liquid. Such high proportion of carrier liquid is necessary mainly to provide electrophoretic mobility for the toner particles to migrate towards the photoconductor for image deposit formation.

Such prior art toning processes have two inherent disadvantages in high speed microimagery: first, a finite time is required for the toner particles to migrate to the photoconductor for image deposit formation; and second, after image deposit formation a relatively large quantity of carrier liquid or unused liquid toner remains on the photoconductor and must be removed therefrom.

The toning process of the invention overcomes both of the above disadvantages since first, the toner, as applied to the photoconductor, is in the form of a pre-deposit consisting of closely packed toner particles surrounded only by carrier liquid. The proportion of toner particles is in the range of 60-90 percent to 40-10 percent of carrier liquid. Accordingly, the quantity of carrier liquid per se applied to the photoconductor is very much less than in the prior art process and thus, is rapidly removable therefrom. Second, image deposit formation is by donor toning or transfer toning, that is accomplished by a virtually instantaneous transfer of toner particles from the pre-deposit to the photoconductor. In order to provide a high throughput, which is usually limited by the liquid toner and the time it takes for the electrophoretic transfer of the toner particles through the liquid carrier, the arrival of the imaged photoconductor at the toning station is anticipated and the toned carrier is waiting in place for virtual instantaneous toning of the image to reduce process time. In other words, by pre-toning the applicator and electrostatically transferring the toner to the photoconductor the through-put goes up substantially.

The pre-deposit of toner particles in accordance with this invention is formed on a carrier member only in an area corresponding to the frame to be toned in order to prevent soiling of the photoconductor in areas outside of the frame.

Figure 1:
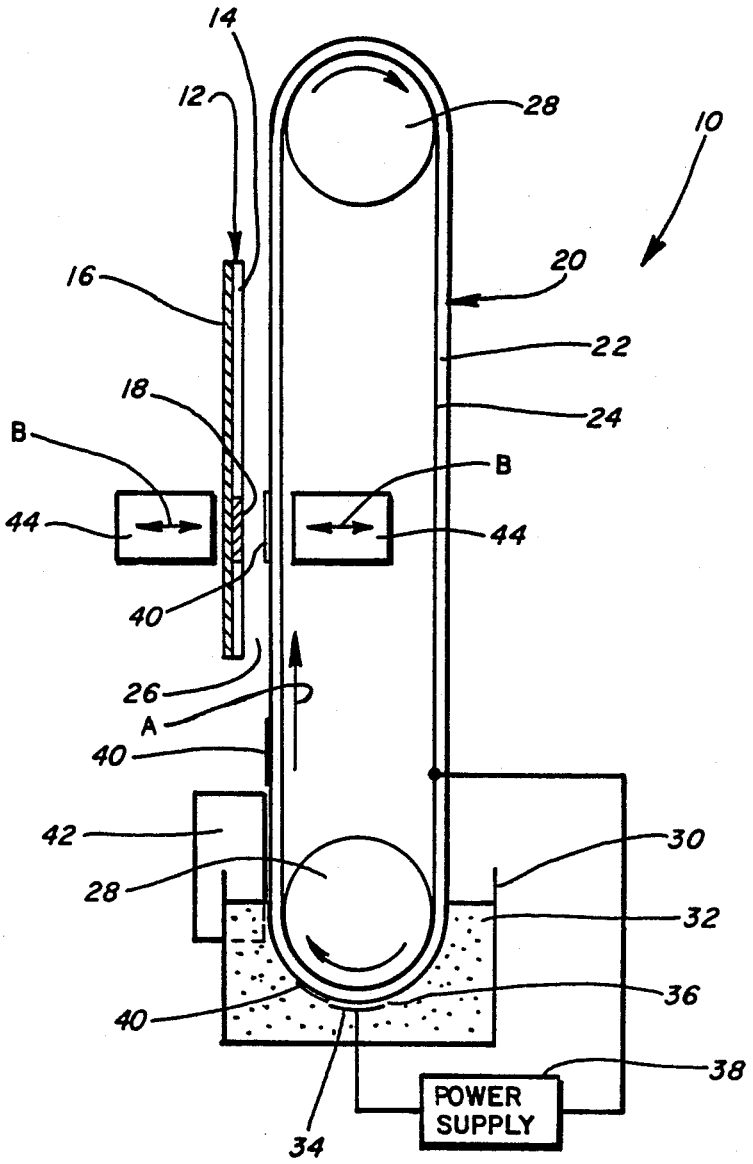
FIG. 1 is a schematic representation illustrating one embodiment of the apparatus used for practicing the method of the invention and depicting toner pre-deposited on a belt which will be transferred to the photoconductor.

Referring now to FIG. 1 the system of the invention is illustrated generally by reference numeral 10. The system 10 includes a microfiche 12 having a photoconductor 14 on an optionally transparent conductive substrate 16. The microfiche 12 is located in a processing position that is preparatory to toning a selected electrostatically charged and imagewise exposed fractional area or frame 18 thereon. A carrier member 20 in the form of an flexible belt is also included having a dielectric layer 22 on a conductive substrate 24. The carrier member 20 is spaced a small distance 26 away from the microfiche 12 and is driven in the direction indicated by arrow "A" by wheels or rollers 28, which are indexed by suitable programming means (not illustrated) to stop or move as required for synchronization of the process steps. The width of the carrier member or belt 20 can be the same as that of the frame 18, or wider if so required, for providing perforations or other indexing means on the outer edges thereof for precise positioning.

The lower part of the carrier member 20 is partially immersed in a tank 30 containing a liquid toner 32. A depositing electrode 34, or so-called coronode, is positioned over a narrow gap 36 adjacent to the dielectric layer 22. The electrode 34 and the conductive substrate 24 are connected to a power supply 38, the polarities being so selected that the toner particles in the liquid toner 32 are repelled by the electrode 34 and urged toward the dielectric layer 22 to form toner pre-deposits 40 thereon. The power supply 38 is switched on an off by means not shown in synchronism with the drive rollers 28 in order to stop or move the carrier member 20 so as to form on the dielectric layer 22, at predetermined intervals, the toner pre-deposits 40 precisely corresponding in size to the frame 18. Such toner pre-deposits 40 are then carried on the carrier member 20 past a solvent limiting means 42 toward the microfiche 12, and, as predetermined by the programming drive rollers 28, the carrier member 20 is stopped in a position where one of the toner pre-deposits 40 is precisely in juxtaposition with the selected frame 18 to be toned, but separated therefrom by the small gap 26. Plungers 44 located both behind the microfiche 12 and the carrier member 20 are adapted to move back and forth in the direction shown by the arrows "B" in order to press the microfiche 12 and the carrier member 20 together or to keep them apart, as actuated by the programming for process synchronization.

Figure 2:
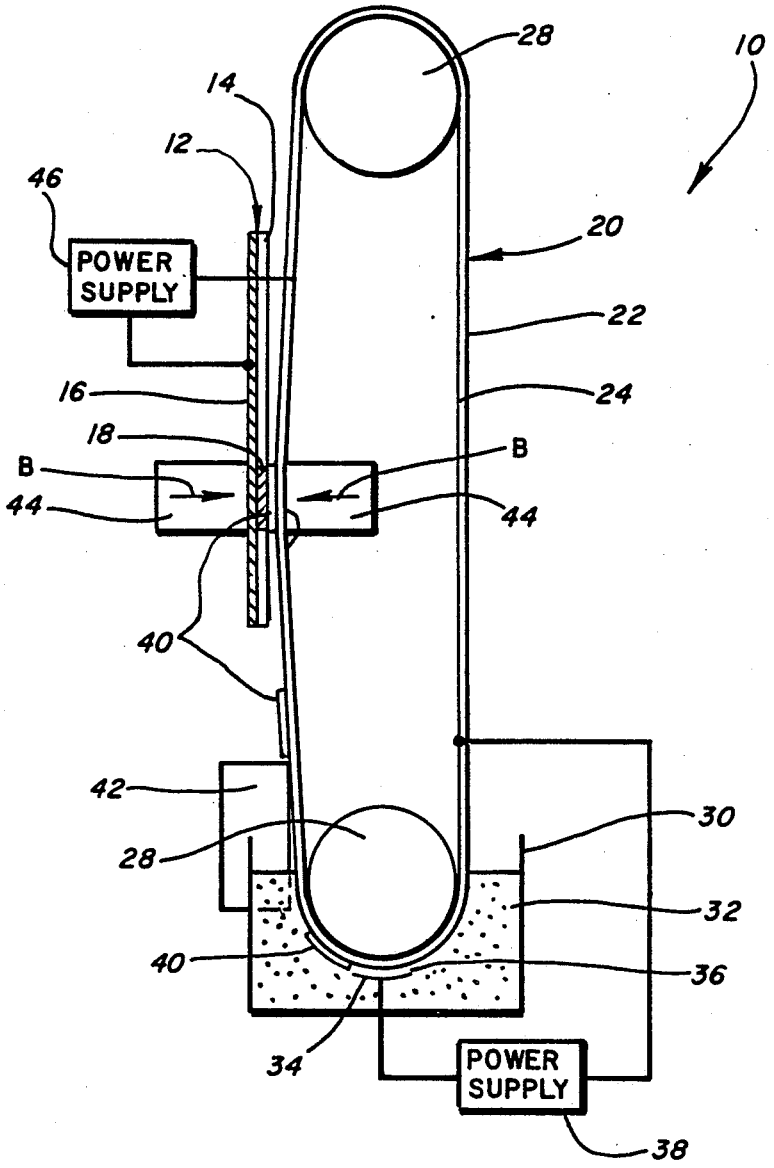
FIG. 2 is a schematic representation similar to FIG. 1 and depicting the step of transfer toning of the image on the photoconductor.

FIG. 2 illustrates the steps of toning. As a toner pre-deposit 40 is carried to the toning position opposite the frame 18 as shown in FIG. 1, the programming stops the drive rollers 28 and the carrier member 20 for a fraction of a second required for toning. Simultaneously, the plungers 44 are caused to press the microfiche 12 and the carrier member 20 together, as shown in FIG. 2. At the same time a bias voltage is applied by a power supply 46 between the conductive substrate 16 of the microfiche 12 and the conductive substrate 24 of the carrier member 20, the polarity being so selected that the pre-deposit 40 is imagewise released from the dielectric layer 22 of the carrier member 20 and is transferred onto the latent image areas on the frame 18 of the microfiche 12.

Figure 3:
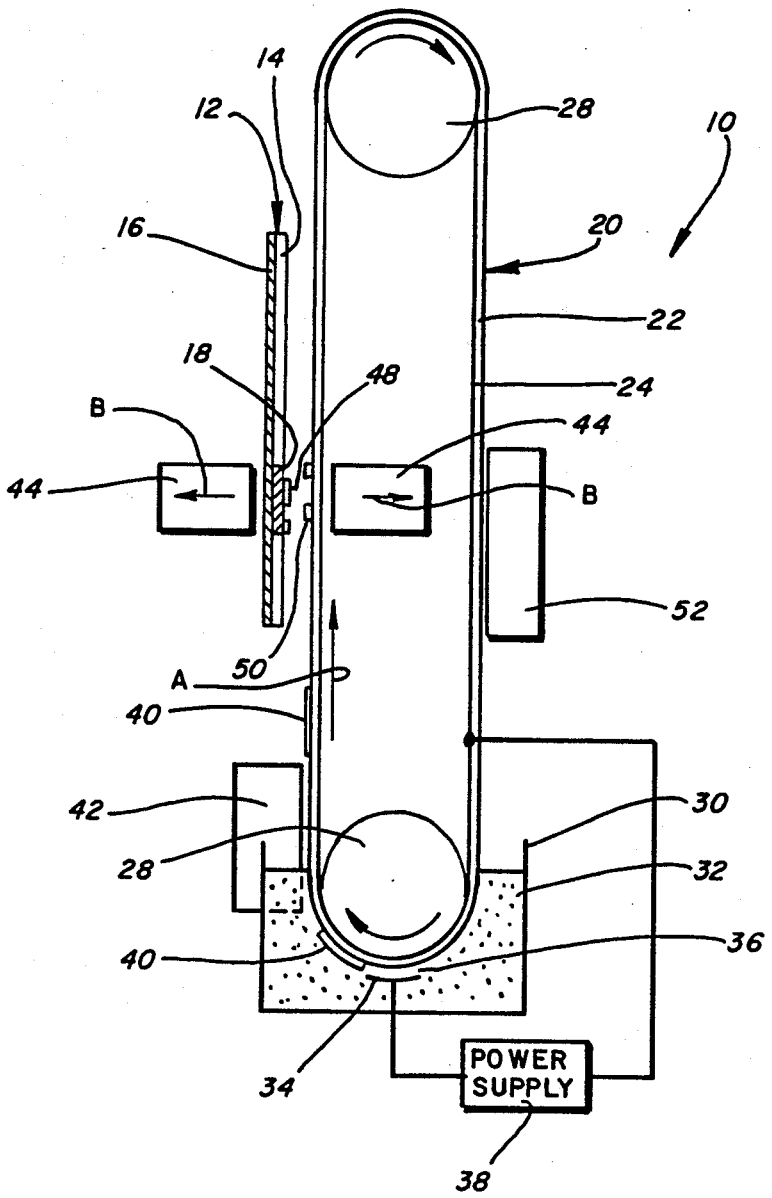
FIG. 3 is a schematic representation similar to FIGS. 1 and 2 and depicting the image and the photoconductor after transfer toning.

FIG. 3 illustrates the thus formed toner image deposit 48 on the selected frame 18 and the toner residue 50 on the dielectric layer 22. The image deposit 48 can now be dried and fused onto the frame 18 or transferred therefrom onto a receptor (not illustrated). After transfer toning of the frame 18, the plungers 44 move in the direction shown by the arrows "B" to separate the microfiche 12 from the carrier member 20 and the drive rollers 28 move the carrier member 20 in the direction shown by the arrow "A" through a cleaning station 52 to remove the toner residue 50 therefrom preparatory to forming another pre-deposit thereon for a subsequent toning step.

In the embodiment illustrated in FIGS. 1-3, the carrier member 20 is in the form of a belt made of flexible dielectric material 22 such as polyester having its inner surface metallized or coated with conductive material 24. The toner pre-deposits 40 are formed by passing the carrier belt 20 in a location preceding the processing position through the liquid toner 32, providing the depositing electrode 34 close to the surface of the carrier belt 20, and applying a potential difference between the electrode 34 and the conductive side 24 of the carrier belt 20 to deposit toner particles onto the dielectric layer 22. The thickness of the thus formed toner pre-deposit 40 is determined by the final image density required on the photoconductor 14 and can be controlled at constant belt speed by the toner concentration, the distance between the depositing electrode 34 and the dielectric belt surface, and the potential difference applied. To produce the toner pre-deposits 40 at predetermined intervals, the potential difference can be applied at intervals by indexing, where the duration of such intervals corresponds to the transit of the carrier belt 20 through the liquid toner 32 over one frame length in which case the electrode 34 is preferably in the form of a knife-edge to ensure sharp leading and trailing edges of the toner pre-deposit 40. Alternatively, the carrier belt 20 can be indexed to stop at intervals for a time during which a frame size toner pre-deposit 40 is formed thereon by applying the potential difference during such an interval to a frame size depositing electrode 34. As a further alternative, toner pre-deposits 40 at predetermined intervals can be formed by moving the carrier belt 20 past a corona generator while grounding its conductive substrate 24 to electrostatically charge the dielectric layer 22 to a desired surface potential, wherein the carrier belt 20 is stopped at indexed intervals to selectively charge a frame area only while masking the surrounding area with a grounded shield, followed by toning. Toning can be effected by passing the carrier belt 20 through a toning device as shown in the drawings or by contacting the carrier belt 20 as it stops at indexed intervals with a toning device adapted to apply a metered quantity of liquid toner to a frame size area, followed by purging most of the liquid therefrom, where during the toning interval a potential difference is applied between the conductive substrate 24 of the carrier belt 20 and the developing electrode in the toning device. In this case a preferably flat backing member needs to be positioned in contact with the reverse side of the carrier belt 20 behind the area being toned to provide exact alignment for the toning device on the other side of the carrier belt 20.

In substantially the same embodiment as illustrated in FIGS. 1–3, the carrier belt 20 is again made of flexible material such as polyester, but its outer or toner pre-deposit receiving surface is metallized or coated with a conductive material. The toner pre-deposits 40, at predetermined intervals, can be formed on the conductive surface of the carrier belt 20 by a toning device as shown in the drawings, with the exception that in this case the potential difference is applied between the depositing electrode 34 and the conductive surface of the belt. Alternatively, a toning device as above referred to can be employed to contact the carrier belt 20 as its stops at indexed intervals to apply liquid toner 32 thereto in frame size areas, and in this case during the toning interval a potential difference is applied between the conductive surface of the belt and the developing electrode in the toning device. If so desired, the outer conductive surface of the carrier belt 20 can contain at predetermined intervals insulative toning areas formed for instance by adhering thereto, at the appropriate spacing frame size, pieces of insulative film such as polyester to form protruding toning areas. The preferred method of forming the toner pre-deposits 40 on such insulative toning areas is to move the carrier belt 20 past a corona generator while grounding the metallized or conductive surface of the carrier belt 20 beneath the insulative areas to the desired surface potential, followed by pre-depositing toner particles thereon by any of the above described toning methods.

As shown in the embodiment illustrated in FIGS. 1–3, following the formation of the toner pre-deposits 40 on the carrier member 20 and prior to the step of transfer toning, the carrier belt 20 moves past a solvent limiting device 42 where carrier liquid remaining in the pre-deposits 40 is reduced to the very minimum required for transfer toning. Such solvent limiting devices 42 can be in the form of an air stream, vacuum suction, so-called squeegee corona, or a so-called extractor roller, or other means. If an extractor roller is used, by precisely controlling the distance between the extractor roller and the toner pre-deposit 40, the speed and direction of rotation of the roller and the potential difference applied between such roller and the conductive side of the carrier member 20, not only the quantity of liquid remaining on the toner pre-deposits 40 can be controlled, but also the thickness and compactness of the pre-deposit 40 can be metered to provide the best condition for transfer toning.

Figure 4:
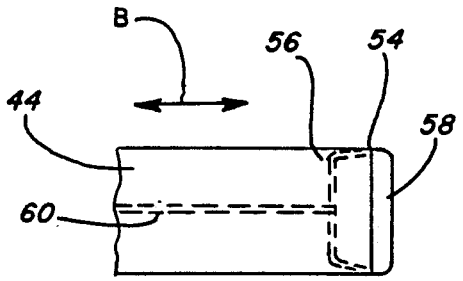
FIG. 4 is a fragmentary elevational view of one embodiment of a backing member for practicing the invention and illustrating an internal cavity and air path therein in dotted outline.

As stated in the foregoing, for toning the selected frame 18, the pre-deposit 40 on the carrier belt 20 is moved into juxtaposition therebetween and at a small distance therefrom, just sufficient to provide clearance to prevent distortion of the pre-deposit 40 by contact with the photoconductor 14 during transit. At such time the carrier belt 20 stops and virtual contact is established between the photoconductor 14 and the pre-deposit 40 by pressing the microfiche 12 and the carrier member 20 together. This can be effected by providing substantially frame size backing members such as plungers 44 as illustrated behind the frame 18 to be toned and behind the pre-deposit 40 on the carrier belt 20, and causing both such backing members 44, by appropriate programming, to simultaneously move forward and press the photoconductor 14 and the carrier belt 20 against each other, and then to withdraw after toning. As FIG. 4 illustrates, such movement of the backing members or plungers 44 can be effected, for instance, by means of programmed solenoid operation compressed air or the like, in which case an active end 54 of such plungers 44 can be made of appropriately shaped resilient or compliant material in order to obtain uniform contact over the whole frame area. If desired, only one plunger 44 need be movable while the other remains stationary. Alternatively, virtual contact for transfer toning can be effected by compressed air operation, in which case the backing members 44 themselves are stationary and their active ends 54 contain a cavity 56 in which is located an inflatable bag 58 made of flexible material.

Figure 5:
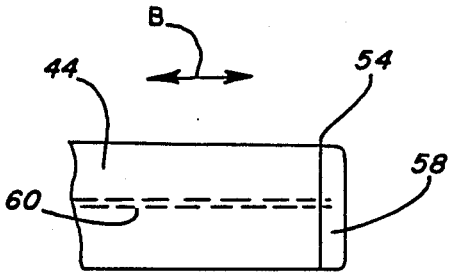
FIG. 5 is a fragmentary elevational view similar to FIG. 4 and illustrating said backing member without an internal cavity.

When inoperative, the bag 58 is deflated and in such a condition that it is out of contact with the photoconductor 14 and/or the carrier belt 20. To obtain virtual contact between these two members, compressed air is admitted to inflate the bag 58 through an air line 60 and thereby to press it against the photoconductor 14 and/or the carrier belt 20 for the required time for transfer toning, after which time the air is exhausted. Admission and exhaust of compressed air through the air line 60 can be conveniently operated by programmed solenoid valves. As FIG. 5 illustrates, instead of being in a cavity 56 in the active end 54 of the backing member 44, the inflatable bag 58 may itself form the active end 54. The advantage of this would be that at least that portion of the inflatable bag 58 which effects virtual contact can be made in substantially the shape of a frame 18 with a slightly convex middle if desired, whereby due to such shape and compliance of the bag 58 very uniform contact is attained.

Upon establishing virtual contact between the charged and exposed photoconductor surface 14 and the toner predeposit 40 on the carrier member 20, transfer toning is effected by applying, during the toning time, a potential difference between the conductive layer 16 underlying the photoconductor 14 and the conductive layer 24 of the carrier member 20. The magnitude of such potential difference will depend mainly on the surface voltage of specific types of photoconductors, and it will be realized that depending on the direction of the thus established electrical field between the photoconductor 14 and the carrier member 20, it is possible not only to effect instantaneous and complete transfer toning, but also to control transfer toning if so desired to improve gray scale or continuous tone, for instance.

In certain instances background fog can also be eliminated by pre-wetting the frame 18 to be toned on the photoconductor 14 with an insulative liquid such as an isoparaffinic hydrocarbon or a fast evaporating fluorinated hydrocarbon immediately before a virtual contact is made with the toner pre-deposit 40 on the carrier member 20.

The residue of the toner pre-deposit 40 remaining on the carrier member 20 after transfer toning is removed therefrom in the cleaning station 52 as shown in the drawings by appropriate cleaning means such as a scraper blade made of resilient material or a foam pad or foam coated rotating roller preferably immersed in pure carrier liquid or some other suitable solvent, followed by drying that can be carried out by vacuum suction or air stream or the like. In those instances where the dielectric surface 22 of the carrier member 20 is charged by a corona generator for the formation of the toner pre-deposits 40 thereon, it is preferable after cleaning and drying to discharge such surface by means of a corona generator connected to an AC power supply to ensure uniform surface charge deposition thereon in the following step of charging preparatory to the formation of the next pre-deposit.

Figure 6:
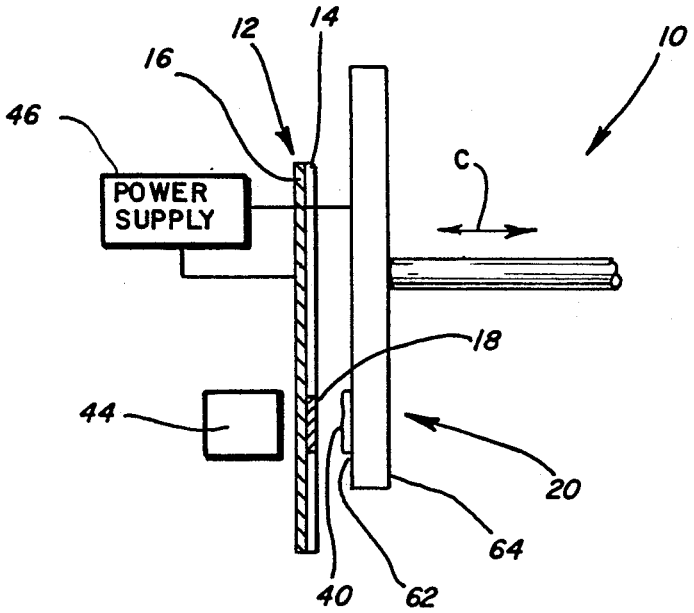
FIG. 6 is a schematic representation similar to FIG. 1 and depicting the toner pre-deposited on a disc instead of the belt.

In another embodiment of this invention, illustrated in FIG. 6, the carrier member 20 is of rigid material and contains one or more toning areas 62 corresponding substantially to a frame size. Such toning areas 62 can be, for instance, in the form of protrusions appropriately spaced around the circumference of a disc 64 which is caused to rotate stepwise or is indexed to move the toning area 62 into the processing position and into juxtaposition with the selected frame 18 and to stop in such position for a short time during which virtual contact is made between the photoconductor 14 and the toner pre-deposit 40 on the toning area 62 for transfer toning. As in the previous embodiments, the distance between the photoconductor 14 and the toning area 62 when in juxtaposition need only be sufficient to provide a small clearance, such as, about one millimeter, between the photoconductor 14 and the surface of the toner pre-deposit 40 on the toning area 62. Such toning areas 62 can have a dielectric or conductive surface (not illustrated) on which the pre-deposit 40 is formed by any of the toning methods described in the foregoing in relation to dielectric or conductive carrier belt member surfaces. The movement needed to effect virtual contact can be effected, for instance, by actuating a backing member 44 of the type described in the foregoing behind the frame 18 to be toned and simultaneously moving forward the carrier member 20 along the line "C" by solenoid operation or the like. As an alternative in this embodiment, the toning areas 62 are not in the form of protrusions but are appropriately spaced dielectric or conductive planar frame size areas around the actual circumference or face of the disc 64, or the whole circumference or face of the disc 64 can be dielectric or conductive and have pre-deposits 40 formed thereon at predetermined intervals by the same methods as described in the foregoing in relation to the carrier belt members. In this instance, the disc 20 can be as wide as the frame 18 to be toned, or wider, if desired.

According to the invention, the methodology employed to form toner pre-deposits 40 on the carrier member 20 and to clean and discharge same have no effect whatsoever on the high speed at which a frame 18 on the photoconductor 14 can be toned and then dried and fused. All steps of the methodology can be performed successively on the areas of the pre-deposits 40 following each other on the moving carrier member 20 or on one area of the pre-deposit 40 thereon as it moves past suitably located stations adapted to perform each of such steps in sequence.

In practice, a microimagery reproduction system 10 may comprise information acquisition as well as retrieval modes. In a preferred system when a particular frame 18 on a particular microfiche or card 12 is selected for acquisition of information, by appropriate programming the photoconductor microfiche 12 is caused to move into a location where the selected frame 18 thereon enters the processing position, and simultaneously therewith the carrier member 20 is caused to move one toning area to a position where a toner predeposit 40 is formed thereon, followed by moving such toning area to the processing station at the exact time to transfer tone the selected frame 18 on the photoconductor 14 immediately after it has been charged and exposed, following which the microfiche 12 is moved to a drying and fusing station or to a transfer station for transfer of the image deposit to a receptor, while the carrier member 20 is moved to the cleaning station 52 before the next toner pre-deposit is formed thereon. It should be realized however that the method of this invention is applicable irrespective of the manner in which the microfiche 12 or card or film and/or the toning device of this invention are moved in an apparatus through the various process steps and are brought together for transfer toning.

Figure 7:
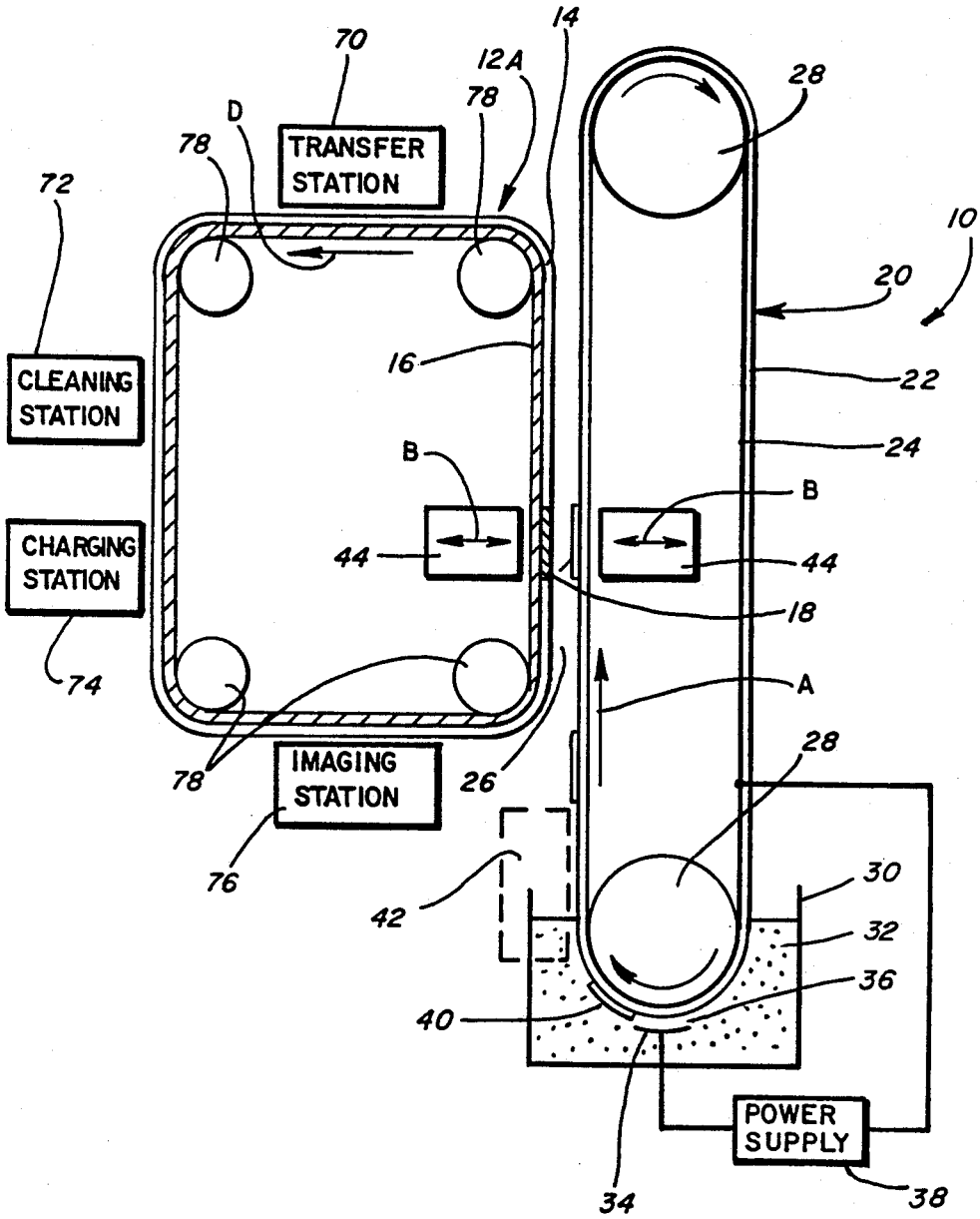
FIG. 7 is a schematic representation similar to FIG. 1 and depicting a belt photoconductor instead of a rectangular microfiche.

As an alternative example, FIG. 7 illustrates another embodiment of this invention, where common elements are referred to by the same numerals. In the previous embodiments, the microfiche 12 has been employed where the multiple images are placed on a rectangular form that is usually transparent. Alternatively, the microfiche 12 can be replaced with a photoconductor **12*a* that is in the form of a belt of appropriate length and of such a width to at least contain the desired image width. Once the image 48 is toned, the photoconductor belt 12*a* is moved so that the toned image can be more conveniently transferred to another surface (not illustrated) at a transfer station 70. Thereafter the photoconductor belt 12*a* can be moved to be cleaned in a cleaning station 72, charged in a charging station 74, imaged in an imaging station 76, and again moved into position for toning. The photoconductor belt 12*a* can be moved in the direction of arrow "D" to the respective stations 70, 72, 74 and 76 by rollers 78** or the like.

It is also to be noted that the toner applicator or carrier member 20 and photoconductor **12*a* or microfiche 12** need not be oriented in any particular way in space so long as they accomplish the functions described above.

There has been described a novel method of and means for virtual instantaneous toning of fractional areas on photoconductors by transferring thereto from a carrier member toner pre-deposits containing a minimal quantity of carrier liquid whereby such areas can be rapidly dried for further processing at high speed. Modifications and variations in the invention as disclosed may occur to the skilled artisan without departing from the scope of the invention as set forth in the appended claims.

I claim:

1. A method of toning a fractional area on a photoconductor to a predetermined image density that prevents dispersion of any liquid toner or carrier liquid beyond the fractional area to be toned and is capable of rapid drying comprising the steps of:

providing a photoconductor disposed over a conductive substrate having at least one fractional area thereon that is to be toned;

providing a carrier member having a conductive layer;

electrostatically depositing liquid toner on said carrier member to form thereon a toner pre-deposit of desired density in an area substantially corresponding to said fractional area to be toned on said photoconductor;

contacting said toner pre-deposit on said carrier member with said fractional area on said photoconductor;

toning said fractional area on said photoconductor by transferring toner thereto from said toner pre-deposit so that the quantity of liquid transferred to said photoconductor is minimal and can be rapidly removed therefrom without affecting the toner deposit on said photoconductor.

2. The method as defined in claim 1 including providing a backing member for support of said photoconductor during contact with said carrier member.

3. The method as defined in claim 2 including providing a backing member for support of said carrier member during contact with said photoconductor.

4. The method as defined in claim 1 including reducing the liquid contained within said fractional area on said carrier member before toning.

5. The method as defined in claim 1 including applying a bias voltage between said conductive substrate of said photoconductor and a said conductive layer of said carrier member during transfer toning 6. The method as defined in claim 1 including forming said toner pre-deposits on said conductive surface with a depositing electrode.

7. The method as defined in claim 1 wherein said carrier member includes a dielectric layer on said conductive layer and including forming said toner pre-deposits on said dielectric layer with a depositing electrode.

8. The method as defined in claim 1 wherein said carrier member includes a dielectric layer on said conductive layer and including forming said toner pre-deposits on said dielectric layer by electrostatically charging the dielectric in fractional areas, followed by liquid toning.

9. The method as defined in claim 1 wherein said carrier member is a flexible belt.

10. The method as defined in claim 1 wherein said carrier member is a disc.

11. The method as defined in claim 1 including separating said photoconductor from said carrier member after toning.

12. The method as defined in claim 1 including removing any remaining parts of said pre-deposit from said carrier member after toning.

13. The method as defined in claim 11 wherein after separating said photoconductor from said carrier member said method further includes transferring the toner deposit on said photoconductor to another surface, cleaning the photoconductor, charging the photoconductor, and imaging the photoconductor with a desired image.

14. The method as defined in claim 13 wherein said photoconductor is a flexible belt movable between designated positions to accomplish said transferring, cleaning, charging and imaging.

15. A toner applicator for toning a fractional area on a photoconductor to a predetermined image density that prevents dispersion of any liquid toner or carrier liquid beyond the fractional area to be toned and is capable of rapid drying comprising:

a photoconductor disposed over a conductive substrate having at least one fractional area thereon that is to be toned;

a carrier member having a conductive layer and electrostatically deposited liquid toner thereon to form a toner pre-deposit thereon of desired density in an area corresponding to said fractional area to be toned on said photoconductor, said carrier member being in close proximity to said photoconductor;

means for contacting said toner deposit on said carrier member with said fractional area on said photoconductor; and means for toning said fractional area on said photoconductor by transferring toner thereto from said toner pre-deposit so that the quantity of liquid transferred to said photoconductor is minimal and can be rapidly removed therefrom without affecting the toner deposit on said photoconductor.

16. The toner applicator as defined in claim 15 including means for reducing the liquid contained within said fractional area on said carrier member.

17. The toner applicator as defined in claim 16 wherein said means for toning includes means for applying a bias voltage between said conductive substrate of said photoconductor and said conductive layer of said carrier member.

18. The toner applicator as defined in claim 15 including a depositing electrode for forming said toner pre-deposits on said conductive layer.

19. The toner applicator as defined in claim 18 wherein said carrier member is a flexible belt.

20. The toner applicator as defined in claim 18 wherein said carrier member is a disc having a planar face.

21. The toner applicator as defined in claim 20 wherein said disc includes protruding conductive toning areas on its face.

22. The toner applicator as defined in claim 15 wherein said carrier member includes a dielectric layer on said conductive layer.

23. The toner applicator as defined in claim 22 including a depositing electrode for forming said toner pre-deposits on said dielectric layer.

24. The toner applicator as defined in claim 23 wherein said carrier member is a flexible belt.

25. The toner applicator as defined in claim 23 wherein said carrier member is a disc having a planar face.

26. The toner applicator as defined in claim 25 wherein said disc includes protruding dielectric toning areas on its face.

27. The toner applicator as defined in claim 22 including means for electrostatically charging said dielectric in fractional areas to form said toner pre-deposits on said dielectric layer and further including means for liquid toning said pre-deposits.

28. The toner applicator as defined in claim 27 wherein said carrier member is a flexible belt.

29. The toner applicator as defined in claim 27 wherein said carrier member is a disc having a planar face.

30. The toner applicator as defined in claim 29 wherein said disc includes protruding conductive toning areas on its face.

31. The toner applicator as defined in claim 15 wherein said carrier member includes a plurality of toning areas thereon and includes means for positioning a desired toning area in close proximity to a desired fractional area of said photoconductor for contact and transfer thereto.

32. The toner applicator as defined in claim 15 including first backing means for providing support to said photoconductor during contact with said carrier member.

33. The toner applicator as defined in claim 32 including second backing means for providing support to said carrier member during contact with said photoconductor.

34. The toner applicator as defined in claim 33 wherein said means for contacting includes means for moving said first backing means against said photoconductor to position said photoconductor against said carrier member.

35. The toner applicator as defined in claim 33 wherein said means for contacting includes means for moving said second backing means against said carrier member to position said carrier member against said photoconductor.

36. The toner applicator as defined in claim 33 wherein said means for contacting includes means for simultaneously moving both of said first and second backing means to position said photoconductor against said carrier member.

37. The toner applicator as defined in claim 36 wherein each of said first and second backing means include a plunger having an engagement head on its distal end, said engagement head being resilient in order to obtain uniform contact over the entire fractional area of said photoconductor.

38. The toner applicator as defined in claim 37 wherein said engagement head includes a flexible bag member and said means for moving includes a compressed air means that is activated to inflate said bag and provide said contact between said photoconductor and said carrier member, and said compressed air means is activated to deflate said bag and return said photoconductor to a position proximate to said carrier member.

39. The toner applicator as defined in claim 38 wherein the distal end of each plunger includes a cavity therein and said flexible bag is positioned partially within said cavity during inflation and deflation.

40. The toner applicator as defined in claim 15 including means for removing any remaining parts of said predeposit from said carrier member after toning.

41. The toner applicator as defined in claim 15 wherein said photoconductor is a rectangular microfiche.

42. The toner applicator as defined in claim 15 wherein said photoconductor is a belt.

43. The toner applicator as defined in claim 42 including a photoconductor transfer station, cleaning station, charging station and imaging station and means for moving said belt between said stations.

* * * * *